US006101938A

United States Patent [19]

Adams

[11] Patent Number: 6,101,938

[45] Date of Patent: Aug. 15, 2000

[54] SILKSCREEN REGISTRATION SYSTEM FOR ROTARY SCREEN PRINTING MACHINES

[76] Inventor: Randy L. Adams, 5007 Steffani La., Houston, Tex. 77041

[21] Appl. No.: 09/312,151

[22] Filed: May 14, 1999

[51] Int. Cl.[7] ..... B05C 17/06

[52] U.S. Cl. ..... 101/126; 101/127.1; 101/129; 101/DIG. 36

[58] Field of Search ..... 101/114, 123, 101/126, 127, 127.1, 128.4, 129, 401.1, 485, 486, DIG. 36; 33/614, 615, 616, 617, 619, 620, 621

[56] References Cited

U.S. PATENT DOCUMENTS

| | | | |
|---|---|---|---|
| 5,648,189 | 7/1997 | Newman | 101/127.1 |
| 5,664,495 | 9/1997 | Winter | 101/114 |
| 5,718,057 | 2/1998 | Rosli et al. | 33/617 |
| 5,771,801 | 6/1998 | Newman et al. | 101/127.1 |
| 5,953,987 | 9/1999 | Oleson | 101/127.1 |

*Primary Examiner*—Ren Yan
*Attorney, Agent, or Firm*—Kenneth A. Roddy

[57] ABSTRACT

A system for accurately registering multiple silkscreens relative to a printing surface after they have been clamped into a silkscreen holder of a printing head of a rotary screen printing machine, and for accurate placement of an image on a framed silkscreen. A generally L-shaped registration device attached adjacent to one side of a pallet of the printing machine has first and second sides orthogonal relative to each other with a pair of gauges having visual displays positioned on the first side and a third gauge positioned on the second side. The gauges have outwardly biased plungers controlled by a lever to be simultaneously moved between a retracted positioned, a free-floating position and an engaged position relative to respective first and second sides of a silkscreen frame. The gauge displays allow the operator to take numerical readings to determine if, and how much, a frame has shifted from a zero setting after being clamped in the frame holder, which frame has shifted, to quickly re-register a frame to its previous setting, and to compensate for frames having misaligned images. Another aspect of the invention is an exposure frame for use in conjunction with the registration device having three contacts corresponding to the plunger positions of the registration device that engage a framed silkscreen during exposure of the image to create silkscreens having images aligned relative to the registration frame.

7 Claims, 7 Drawing Sheets

SILKSCREEN REGISTRATION SYSTEM FOR ROTARY SCREEN PRINTING MACHINES

BACKGROUND OF THE INVENTION

1. Field of the Invention

This invention relates generally to registration apparatus for screen printing machines, and more particularly to a registration system for accurately registering multiple silkscreens after they have been clamped into the silkscreen holders of the printing heads of a screen printing machine, and for preparing an image bearing silkscreen to be used therein.

2. Brief Description of the Prior Art

The present invention will be described in connection with, although not limited to, a rotary or carousel screen printing machines, which print on cloth, paper, plastic and other products. These machines have a plurality of flat generally rectangular platens or pallets secured to the outer ends of radial arms mounted on a common turntable rotatable in a path beneath an array of printing stations. Each printing station contains a printing head having a silkscreen frame holder for holding the silkscreen frame. The silkscreen frame has stretched across it the screen material upon which is an exposed image. Typically, the silkscreen frame holder comprises a pair of opposed C-shaped channels which receive the silkscreen frame and a pair of pneumatic clamp members on each channel that lock or clamp the frame into the holder. The printing head may also have an ink dispenser that dispenses ink at one end of the silkscreen and a squeegee that is pulled across the silkscreen to evenly apply the ink. The printing station or printing head may also be provided with heating, drying and other well known structural components. Most commercial printing heads are also provided with micro-adjustment mechanisms to allow small vernier displacements to shift the silkscreen frame a few thousandths of an inch.

Newman et al, U.S. Pat. No. 5,771,801 and Sundqvist, U.S. Pat. No. 5,315,929 disclose various micro-adjustment mechanisms for registering silkscreens.

The pallets support the articles to be printed and are advanced around the printing stations and positioned underneath the silkscreen frame holders of the printing heads, brought into contact with the silkscreens, and a pattern or image of the appropriate color is applied and "squeegeed" through the silkscreen onto the article. Typically, there are two more platens than the number of printing heads so that articles to be printed may be simultaneously placed on one and removed from another without interference from components at the printing heads. In this arrangement, each of the silkscreens in the sequence commonly prints a different image on top of the previously printed image, and this subsequent image is of a different color and design.

It has been recognized that the more consistent the alignment of each image on the screen mesh in each of the silkscreen frames, the less time and effort that is typically required to precisely align the screen printing frames within the printing machine to arrive at production printing. In creating a silkscreen to be used on automated machines of the type described above, a one color graphic design or image is photographically transferred to a piece of film called a film positive, the image being black, the rest of the film being clear.

A common process for creating and applying the artwork or image to the silkscreen is known as a "pin registration system", which utilizes a light table, a pin bar, an exposure table, a rectangular exposure frame, and pin-registered films known as "carrier sheets". A pin bar is secured at one end of a light table. The pin bar is a thin rectangular strip of material having a set of laterally spaced pins projecting upwardly therefrom for receiving corresponding holes punched in a transparent "carrier sheet". The light table may have a grid or a series of lines for assisting in the lay-up. A film positive of the first image to be printed in a first color is aligned and secured to the carrier sheet. The second carrier sheet having holes punched in it is placed on the pin bar. A film positive of the image to be printed in a second color is placed on the second carrier sheet and precisely aligned in superposed relation over the first image and then secured to the carrier sheet. This process is repeated as necessary using subsequent carrier sheets and film positives of the subsequent images to be printed in different colors.

A thin flat generally rectangular exposure frame is secured to the glass top of an exposure table. The exposure frame has a set of pins protruding upwardly from one edge that match the pins of the pin bar, and receive the holes of the carrier sheets having the film positives secured thereto. The exposure frame also has a pair of push pins or stop blocks longitudinally spaced on one side and a third push pin or stop block on a second side that face the central opening and engage two sides of the frame of the silkscreen. A carrier sheet having a film positive of the first image to be printed in a first color is placed on the pins of the exposure frame. A silkscreen coated with a light-sensitive, photochemical translucent emulsion is placed in the exposure frame and two of its sides pushed against the push pins or stop blocks on the two sides of the exposure frame. The vacuum blanket of the exposure table is lowered onto the silkscreen frame and a vacuum is drawn to ensure that there no movement between the carrier sheets and screen mesh. The image is than exposed to a bright light and photochemically developed, or "burned-in", onto the screen. Thus, the image portion of the film positive is burned through the emulsion, leaving that portion of the screen mesh open and porous, while the non-image areas of the film positive will have no effect on the emulsion, thus leaving it on the screen. This process is repeated as necessary using subsequent carrier sheets and film positive images for the various different colors. The exposed silkscreens are washed in a known manner and are then ready to be mounted in the print heads of the printing machine.

Hoffman et al, U.S. Pat. No. 5,129,155, Newman, U.S. Pat. No. 5,648,189, and Winter, U.S. Pat. No. 5,664,495 disclose various apparatus for accurately aligning an image on a silkscreen when the image is transferred to the screen.

It is necessary to preposition, or align the screens before printing, so that, when each screen sequentially prints its portion of the composite print graphic, the images are in the approximate exact positions to accurately reproduce and reflect the original artwork. This process of prepositioning, or aligning multiple screens is called "registering", and before any production run utilizing multiple screens can begin, all the screens must be "registered", to ensure the proper fit of colors. Some designs may require colors to be separated by a required distance, while others may require colors to be aligned edge to edge with no separations. If accurate registration is not accomplished, colors may overlap and "bleed" into one another, or alternatively, be separated when they should be touching. Prints that are "out of register" may be blurry, inaccurate and generally inconsistent with the original artwork.

Numerous methods and systems for prepositioning, or registering silkscreens on a printing apparatus have been known and practiced throughout the history of the art.

In a method commonly used, a film positive of the first piece of artwork or image that was used to create the silkscreen is secured onto one of the pallets and the pallet is rotated beneath the first printing head. A silkscreen having that same piece of artwork or image burned into it is placed into the silkscreen holder of the first printing head. Typically, the first piece of artwork is left in place and all subsequent silkscreens are registered to that same first piece of artwork. The pallet is raised up, and then observing the film positive through the translucent emulsion on the silkscreen, the operator visually aligns the image on the silkscreen with the artwork on the pallet and manipulates the silkscreen manually until the artwork on the screen is aligned with the artwork on the pallet.

The silkscreen frame is then locked into the silkscreen frame by actuating the pneumatic clamps. However, the actuation and clamping action of the clamps will nearly always cause the silkscreen frame to shift slightly, and thus become out of registration. After the silkscreen frame has been locked down by the clamps, and again observing through the translucent emulsion on the silkscreen, the knobs of the micro-registration mechanism are manually turned to move the silkscreen frame holder and silkscreen to adjustably fine-tune the alignment of the silkscreen image to the artwork on the pallet.

After visual registration, the micro-adjustment mechanism is locked down. Then the pallet having the first piece of artwork or image secured to it is lowered and rotated beneath the next printing head having a silkscreen with the next piece of artwork or image for the next color, and the visual registration, clamping, and micro-adjustment process is repeated again, and again with all of the subsequent screens for the subsequent pieces of artwork or images to be reproduced in different colors.

After all of the silkscreens have been visually registered, the printing cycle is then started, and a trial and error procedure is used. A test article is printed, and the results are analyzed to determine necessary screen adjustments. The screen adjustments are accomplished by attempting to analyze which of the silkscreens are out of registration, and then repeating the visual registration, clamping, and micro-adjustment process for the suspected misaligned silkscreens. This time consuming inefficient procedure generally may be repeated several times depending on luck and experience of the printer, thereby increasing the cost because the printing machine is non-operative. Also, this method requires experienced operators or operators with patience to set up the machine for each job. Even with the micro-registration mechanisms, this process requires visual alignment observing the superposed images through the silkscreen having the translucent emulsion on its surface.

Although, the micro-adjustment mechanisms have improved the set-up process, they do not eliminate the cumulative error due to the placement of the silkscreen frames in the silkscreen frame holders and the positioning of the silkscreen frame and image to the printing surface, and have no relationship to the placement of the image on the silkscreen when the image is applied to the silkscreen.

Schlife et al, U.S. Pat. No. 5,226,366 discloses an apparatus and method for centering a silkscreen on a platen and wherein the silkscreen may be aligned on the printing machine using the same or different apparatus by contacting the screen with registration members at the same points of contact used when the screen was aligned for application of the artwork.

Most prior art registration and micro-adjustment devices require visual alignment looking through the screen mesh or visual alignment of an index mark, and do not provide visual numerical indicators that will let the operator know that the silkscreen has shifted, which silkscreen has shifted, or how much it has shifted, and are not capable of providing settings which may be used to re-register the artwork and place the silkscreen frame in its original registered position.

The present invention is distinguished over the prior art in general, and these patents in particular by a system for accurately registering multiple silkscreens relative to a printing surface after they have been clamped into a silkscreen holder of a printing head of a rotary screen printing machine, and for accurate placement of an image on a framed silkscreen. A generally L-shaped registration device attached adjacent to one side of a pallet of the printing machine has first and second sides orthogonal relative to each other with a pair of gauges having visual displays positioned on the first side and a third gauge positioned on the second side. The gauges have outwardly biased plungers controlled by a lever to be simultaneously moved between a retracted positioned, a free-floating position and an engaged position relative to respective first and second sides of a silkscreen frame. The gauge displays allow the operator to take numerical readings to determine if, and how much, a frame has shifted from a zero setting after being clamped in the frame holder, which frame has shifted, to quickly re-register a frame to its previous setting, and to compensate for frames having misaligned images. Another aspect of the invention is an exposure frame for use in conjunction with the registration device having three contacts corresponding to the plunger positions of the registration device that engage a framed silkscreen during exposure of the image to create silkscreens having images aligned relative to the registration frame.

SUMMARY OF THE INVENTION

It is therefore an object of the present invention to provide a silkscreen registration system and apparatus that aligns a framed silkscreen clamped in the frame holder of a printing head of a printing machine by engaging gauges on two orthogonal sides of the frame at preselected points of contact so that registration can be quickly and precisely accomplished by reading the gauges and adjusting the frame and frame holder to achieve a numerical setting corresponding to an accurate registered condition.

It is another object of this invention to provide a silkscreen registration system and apparatus which quickly aligns and positively holds a framed silkscreen in alignment during application of an image to the screen during the exposure process.

Another object of this invention is to provide a silkscreen registration system and apparatus for registering a framed silkscreen on a printing machine which engages gauges on two orthogonal sides of the frame at the same points of contact used to engage the silkscreen frame for alignment during the application of the image to the screen.

Another object of this invention is to provide a silkscreen registration system and apparatus for registering a framed silkscreen on a printing machine that will allow the operator to take numerical readings to determine if, and how much, a frame has shifted from a registered setting after being clamped in the frame holder, which frame out of a plurality has shifted, to quickly re-register a frame to its previous setting, and to compensate for frames having misaligned images.

A further object of this invention is to provide a silkscreen registration system and apparatus that can be easily and quickly operated to precisely align a plurality of silkscreens on printing machines which will significantly reduce set-up time and does not require skilled operators.

A still further object of this invention is to provide a silkscreen registration apparatus that can be easily and quickly connected to existing rotary or carousal printing machines without expensive modification.

Other objects of the invention will become apparent from time to time throughout the specification and claims as hereinafter related.

The above noted objects and other objects of the invention are accomplished by a system for accurately registering multiple silkscreens relative to a printing surface after they have been clamped into a silkscreen holder of a printing head of a rotary screen printing machine, and for accurate placement of an image on a framed silkscreen. A generally L-shaped registration device attached adjacent to one side of a pallet of the printing machine has first and second sides orthogonal relative to each other with a pair of gauges having visual displays positioned on the first side and a third gauge positioned on the second side. The gauges have outwardly biased plungers controlled by a lever to be simultaneously moved between a retracted positioned, a free-floating position and an engaged position relative to respective first and second sides of a silkscreen frame. The gauge displays allow the operator to take numerical readings to determine if, and how much, a frame has shifted from a zero setting after being clamped in the frame holder, which frame has shifted, to quickly re-register a frame to its previous setting, and to compensate for frames having misaligned images. Another aspect of the invention is an exposure frame for use in conjunction with the registration device having three contacts corresponding to the plunger positions of the registration device that engage a framed silkscreen during exposure of the image to create silkscreens having images aligned relative to the registration frame.

DESCRIPTION OF THE PREFERRED EMBODIMENT

Figure 1:
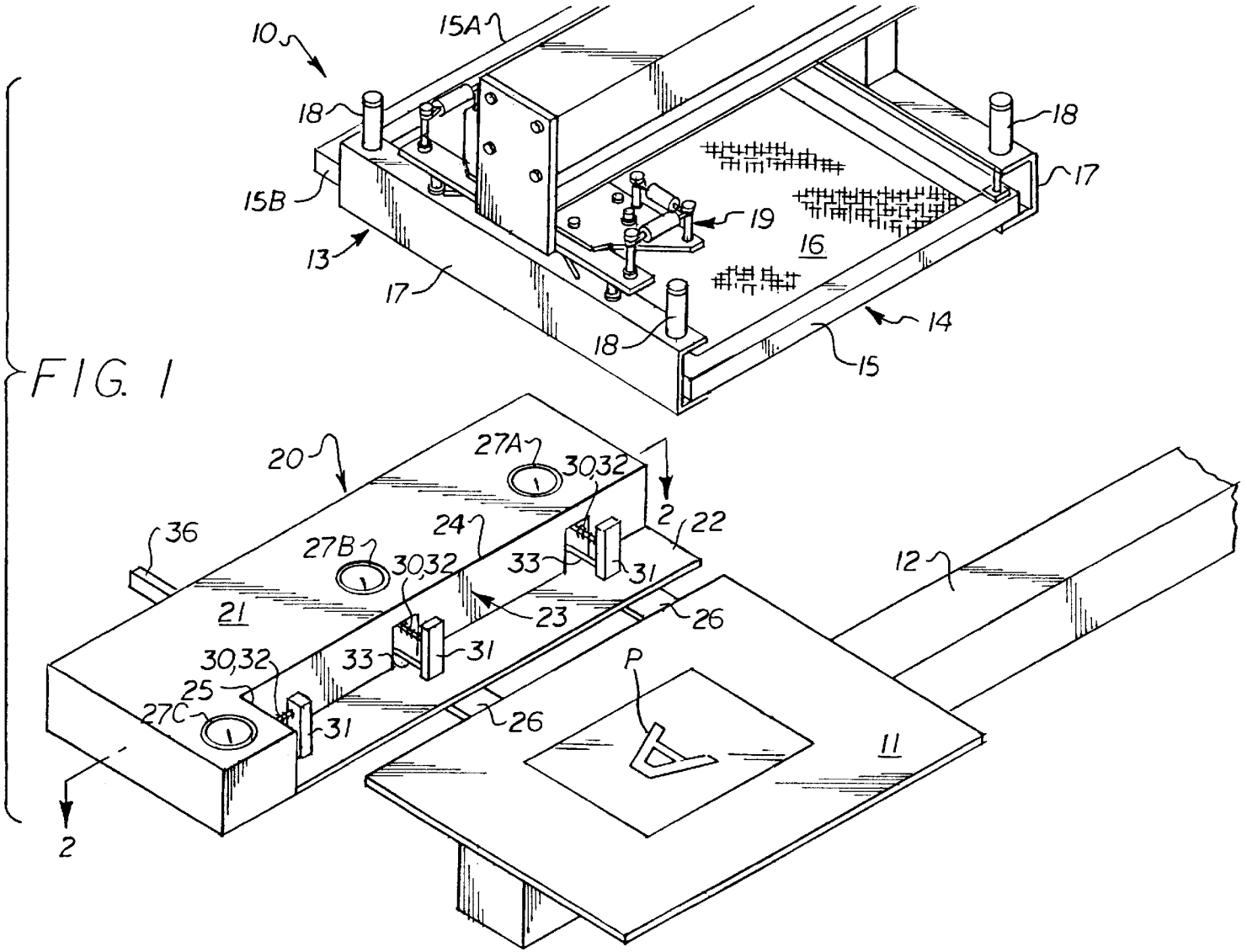
FIG. 1 is a perspective view of a registration device in accordance with the present invention attached to a pallet positioned beneath a printing head of a conventional rotary or carousel screen printing machine.

Referring to the drawings by numerals of reference, there is shown in FIG. 1, a registration device 20 in accordance with the present invention positioned adjacent to a printing head 10 of a conventional rotary or carousel screen printing machine. The printing machine and printing head are of well-known conventional construction and therefore the printing machine is not shown, and the printing head 10 is shown somewhat schematically. The printing machine has a plurality of flat generally rectangular platens or pallets 11 secured to the outer ends of radial arms 12 mounted on a common turntable rotatable in a path beneath a circular array of printing stations containing the printing heads. Each printing head 10 has a silkscreen frame holder 13 for holding a silkscreen 14. The silkscreen 14 has a rectangular frame 15 with the mesh screen material 16 stretched across it upon which is an exposed image (not shown). Typically, the silkscreen frame holder 13 comprises a pair of opposed C-shaped channels 17 which slidably receive the silkscreen frame 15 and a pair of pneumatic clamp members 18 near the outer ends of each channel that lock or clamp the frame 15 of the silkscreen into the channels. The printing heads 10 are also provided with conventional micro-adjustment mechanisms 19 to allow small vernier displacements to shift the frame holder 13 and silkscreen 14 a few thousandths of an inch.

The typical printing head 10 also has an ink dispenser that dispenses ink at one end of the silkscreen and a squeegee that is pulled across the silkscreen to evenly apply the ink, and may also be provided with heating, drying and other components, which are well-known in the art, and therefore not shown.

The pallets 11 support the articles to be printed and are advanced around the printing stations and positioned underneath the silkscreen frame holders 13 of the printing heads, raised into contact with the silkscreens 14, and a pattern or image of the appropriate color is applied and "squeegeed" through the silkscreen onto the article. Typically, there are two more pallets than the number of printing heads so that articles to be printed may be simultaneously placed on one and removed from another without interference from components at the printing heads.

The registration device 20 of the present invention has a generally L-shaped rectangular housing or cover 21 mounted on a flat rectangular bottom plate 22, defining an L-shaped opening 23 with first 24 and second 25 sides orthogonal relative to each other. The registration device 20 is mounted adjacent to a conventional pallet 11 of the printing machine with the L-shaped opening 23 spaced a short distance from one side and the outer end of the pallet, such as by support brackets 26 secured between the bottom plate and underside of the pallet.

Figure 2:
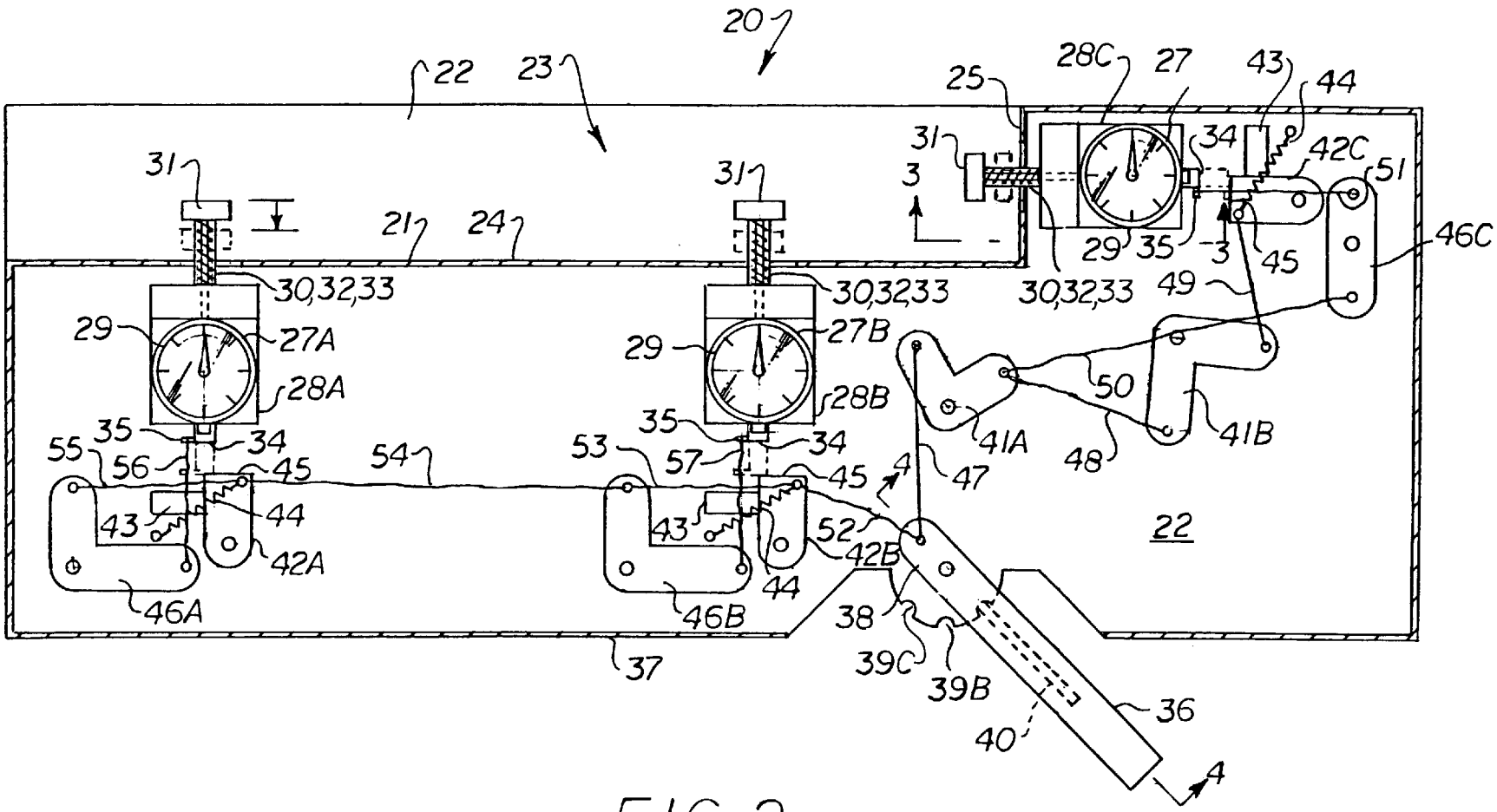
FIG. 2 is a top plan view of the interior of the registration device taken along line 2—2 of FIG. 1, shown with the lever moved to the right and the plungers in an extensible and partially retracted stop position.
Figure 3:
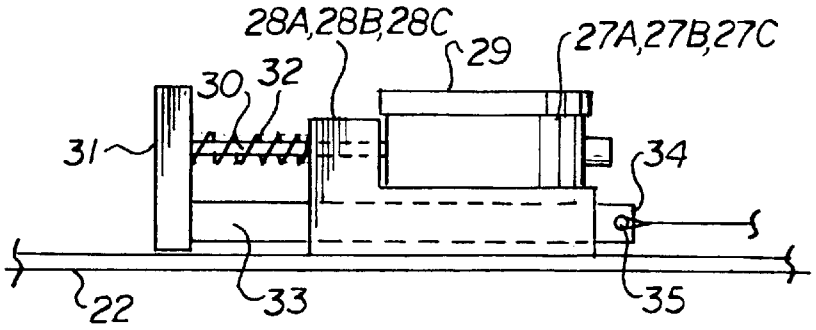
FIG. 3 is a side elevation of a mounting block and dial gauge assembly of the registration device taken along line 3—3 of FIG. 2.

As best seen in FIGS. 2 and 3, three dial gauges 27A, 27B, and 27C are mounted on L-shaped mounting blocks 28A, 28B, and 28C inside the cover 21 with the dial faces 29 extending through three circular openings in the top wall of the cover. Two of the gauges 27A and 27B are positioned adjacent the first side and the third gauge 27C is positioned adjacent the second side of the device 20. Each dial gauge 27A, 27B, and 27C has a plunger 30 that extends slidably through the upstanding leg of the respective mounting block 28A, 28B, and 28C, and a flat rectangular foot element 31 is secured to the outer end of each plunger. The mounting blocks 28A, 28B, and 28C are preferably formed of a low friction material, such as Nylon or Teflon. A compression spring 32 surrounding each plunger 30 is disposed between the L-shaped leg of the mounting block and the foot element 31 to normally urge the foot element and plunger to a normally extended position extending into the L-shaped orthogonal opening 23 of the cover 21.

A round slide rod 33 having a front end secured to the foot element 31 extends slidably through each mounting block 28A, 28B, and 28C parallel the plungers 30, and its back end 34 extends outwardly from the back end of the mounting block. A stop pin 35 is secured to the back end of each slide rod 33. The stop pins 35 engage the back end of the mounting blocks to control the outermost extension distance of the foot elements 31.

Figure 4:
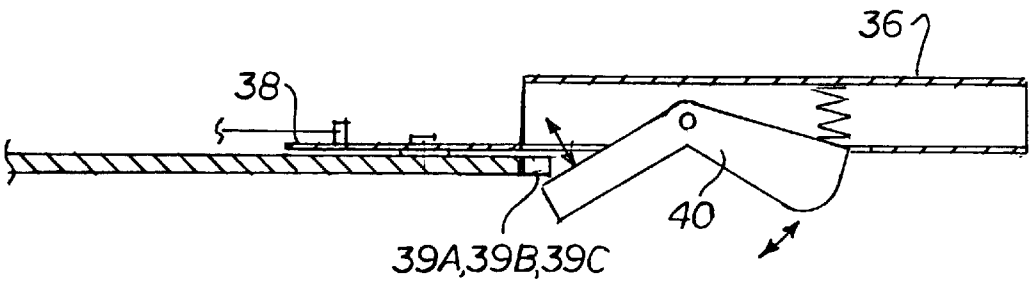
FIG. 4 is a side elevation of the lever of the registration device taken along line 4—4 of FIG. 2.

As best seen in FIGS. 2 and 4, a lever 36 is pivotally mounted near one end to the bottom plate 22 of the device 20 and extends through the side wall 37 of the cover 21. The lever 36 has an extension 38 facing inwardly into the cover 21. Three notches 39A, 39B, and 39C are formed in the bottom plate 22 of the device in a circular circumferentially spaced pattern beneath the lever 36. The lever 36 has a spring biased pivotal trigger 40 which may be manually retracted and released by the hand of the operator to engage and disengage a selected one of the notches 39A 39B, or 39C, as the lever 36 is pivoted about its pivotal mounting. Thus, the operator may selectively move the lever 36 by pulling the trigger 40 up with one finger and engage it in a left-hand, center, or right-hand position, by releasing the trigger. The front extension 38 moves in the opposite direction of the outer portion of the lever 36.

A first L-shaped pivot link 41A is pivotally mounted intermediate its two legs to the bottom plate 22 of the device 20 adjacent to the inward facing lever extension 38. A second L-shaped pivot link 41B is pivotally mounted intermediate its two legs to the bottom plate 22 of the device 20 laterally adjacent to the first L-shaped pivot member 41A.

Three flat generally rectangular stop members 42A, 42B, and 42C are each pivotally mounted at one end to the bottom plate 22 adjacent to the mounting blocks 28A, 28B, and 28C to pivot about their pivotal mountings such that one side of their free ends will engage and disengage a raised stop surface 43 on the bottom plate 22 adjacent to the back end of each mounting block. Three tension springs 44 each having one end secured to the free end of a respective stop member 42A, 42B, 42C, and its opposed end secured to the bottom plate 22 urge the stop members normally against their respective pivot stop surfaces 43. When the stop members 42A, 42B, and 42C are against their stop surfaces 43, their top surfaces 45 are spaced a distance from the back ends of the slide rods 33. In this position, their top surfaces 45 lie on true perpendicular first and second orthogonal planes.

A first and second L-shaped plunger retraction link 46A and 46B are pivotally mounted intermediate their first and second legs to the bottom wall 22 of the device 20 adjacent to the mounting blocks 28A and 28B, and a third generally rectangular plunger retraction link 46C is pivotally mounted between its first and second ends to the bottom wall 22 adjacent to the mounting block 28C.

A cable 47 is connected between the lever extension 38 and the first leg of the first L-shaped pivot link 41A. A cable 48 is connected between the second leg of the first L-shaped pivot link 41A and the first leg of the second L-shaped pivot link 41B. A cable 49 is connected between the second leg of the second L-shaped pivot link 41B and the free end of the stop member 42C.

A cable 50 is connected between the second leg of the first L-shaped pivot link 41A and first end of the plunger retraction link 46C. A cable 51 is connected between the second end of the plunger retraction link 46C and back end 34 of the slide rod 33 in the mounting block 28C.

A cable 52 is connected between the lever extension 38 and the free end of the stop member 42B which is adjacent to the mounting block 28B. A cable 53 is connected between the free end of stop member 42B and the first end of the L-shaped plunger retraction link 46B. A cable 54 is connected between the first end of L-shaped plunger retraction link 46B and the free end of the stop member 42A which is adjacent to the mounting block 28A. A cable 55 is connected between the free end of stop member 42A and the first end of the L-shaped plunger retraction link 46A. Cables 56 and 57 are connected between the back ends 34 of the slide rods 33 in mounting blocks 28A and 28B and the second ends of the L-shaped plunger retraction links 46A and 46B, respectively. The stop members 42A, 42B, and 42C are normally biased against their adjacent stop surfaces 43 by the tension springs 44.

As shown in FIG. 2, moving the lever 36 to the right-hand position (extensible and partially retracted stop position) allows the tension springs 44 to simultaneously pull all three stop members 42A, 42B, and 42C against their respective stop surfaces 43 and pivot the first and second L-shaped pivot links 41A and 41B. With the lever 36 moved to the right, the compression springs 32 will urge the plungers 30, slide rods 33, and the foot elements 31 to their outermost extended position, and allow them to be extended and partially retracted until the back ends 34 of the slide rods 33 contact the top ends of the stop members 42A, 42B, and 42C.

When the slide rods 33 are retracted to engage the top ends 45 of the stop members 42A, 42B, and 42C, the dial displays may be set to zero, whereby the zero and partially retracted stop position is an initial setting representing true perpendicular first and second orthogonal planes to serve as a reference point for the orthogonal sides of the silkscreen frame.

Moving the lever 36 to the center position (FIG. 5) pivots the first and second L-shaped pivot links 41A and 41B and simultaneously pulls all three stop members 42A, 42B, and 42C away from their respective stop surfaces 43 against the tension force of the tension springs 44. With the lever 36 moved to the center position, the compression springs 32 will allow the plungers 30, slide rods 33, and the foot elements 31 to become "free-floating" and to be extended or retracted as the foot elements engage two orthogonal sides of the silkscreen frame (as described hereinafter). As the "free-floating" foot elements 31 engage the sides of the frame, the dial 29 of each dial gauge 27A, 27B, and 27C will indicate the amount of displacement from its zero setting.

Figure 6:
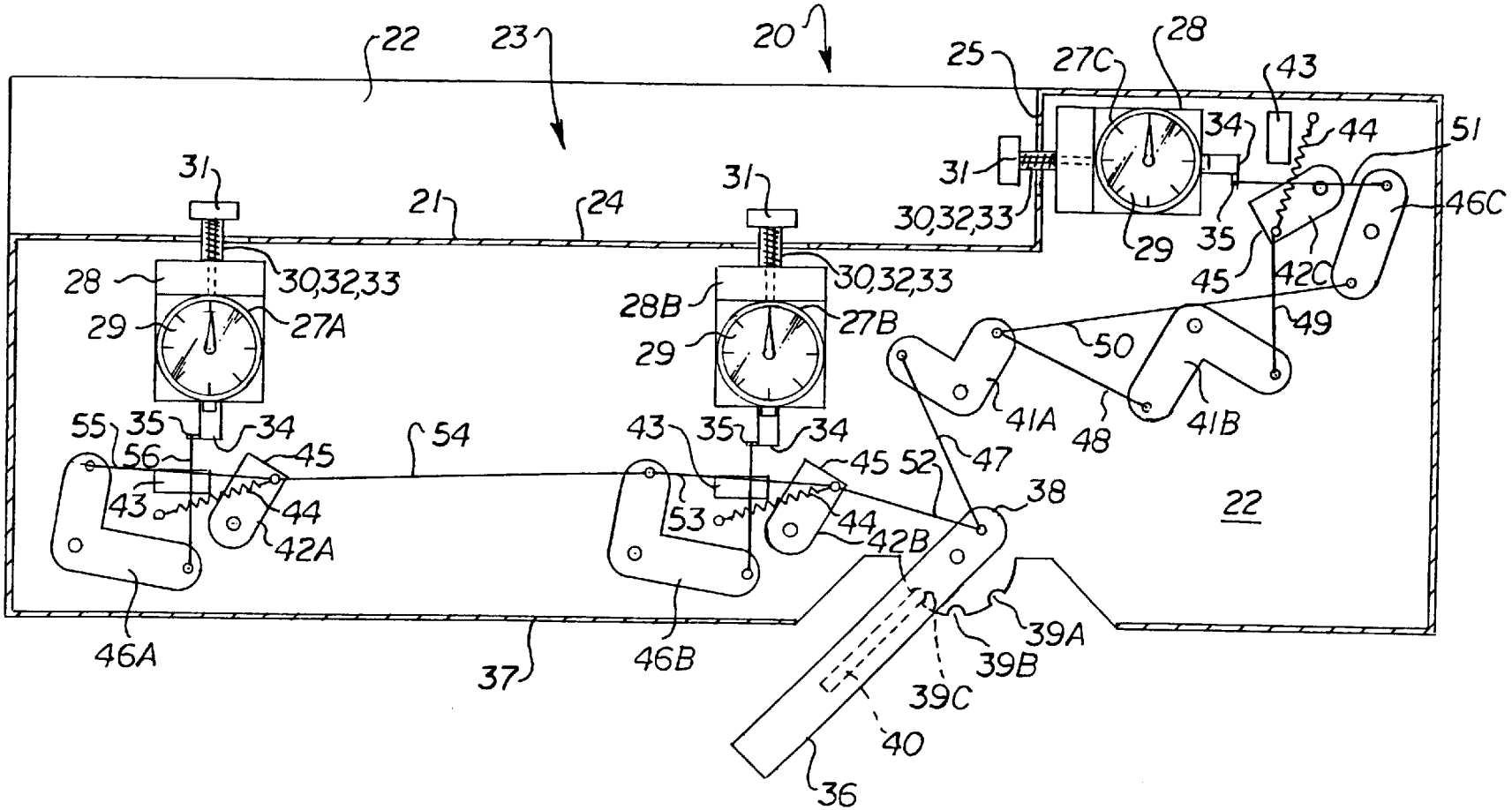
FIG. 6 is a top plan view of the interior of the registration frame, shown with the lever moved to the left and the plungers in their fully retracted position.

As shown in FIG. 6, moving the lever 36 to the left-hand position simultaneously pivots the first and second L-shaped pivot links 41A and 41B, pulls the stop members 42A, 42B, and 42C further away from their stop surfaces 43, and pulls the second ends of the plunger retraction links 46A, 46B, and 46C, away from the mounting blocks 28A, 28B, and 28C to fully retract the plungers 30, slide rods 33, and the foot elements 31.

With the lever 36 moved to the left-hand position and the plungers 30, slide rods 33, and foot elements 31 retracted, the pallet 11 may be raised along with the attached registration device 20 to position the registration device adjacent to two sides of a silkscreen frame which has been previously mounted in the frame holder of the printing head without the foot elements 31 touching or interfering with the sides of the silkscreen frame. After being so positioned, the lever 36 can be moved to the center position to release the plungers 30, slide rods 33, and the foot elements 31 to become free-floating and to become extended or retracted as the foot elements engage the two sides of the silkscreen frame so that a reading of each dial gauge can be taken to register the silkscreen or to determine whether a previously registered silkscreen has shifted (as described hereinafter).

Figure 7:
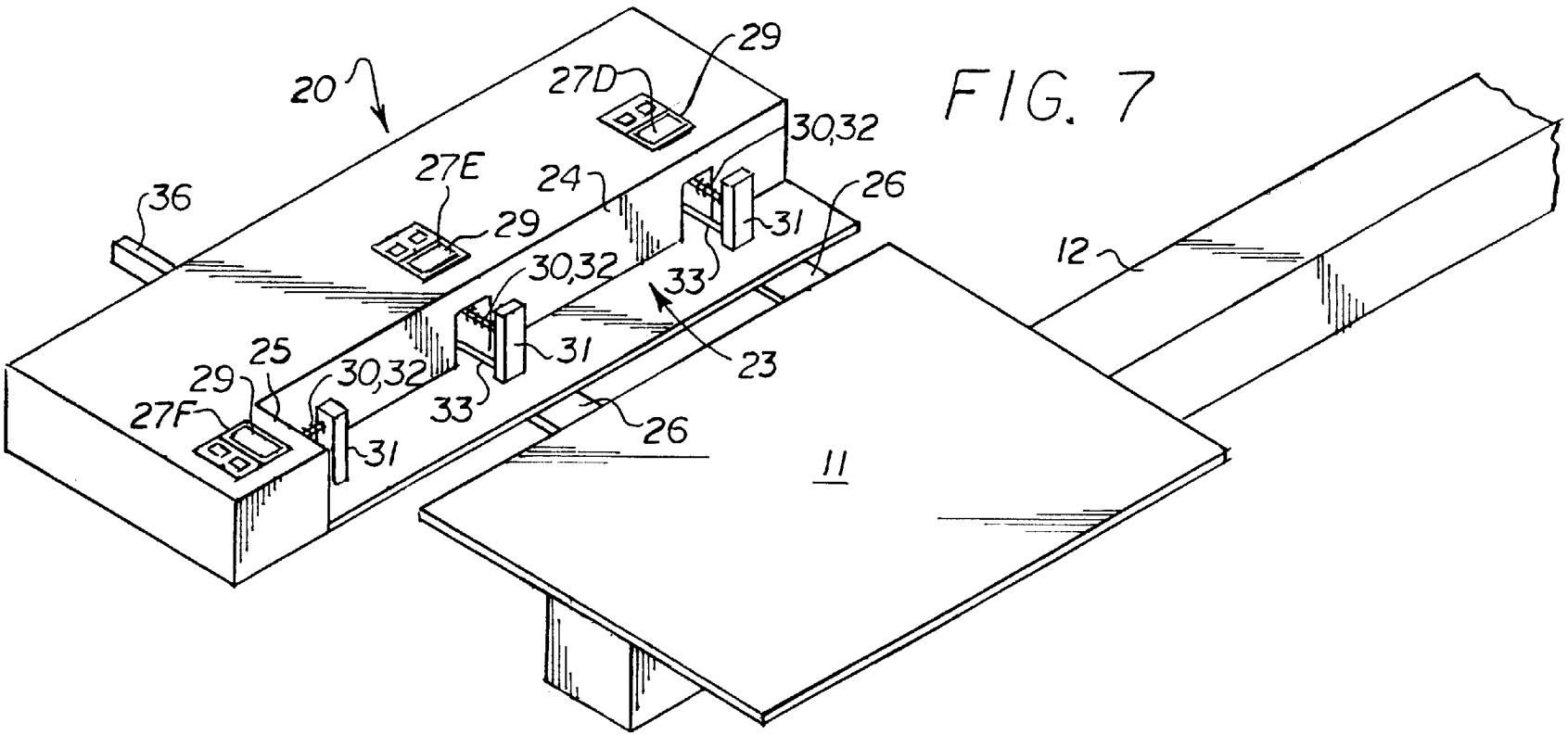
FIG. 7 is a perspective view of a registration device in accordance with the present invention having an electronic digital gauge.

Alternatively, as shown in FIG. 7, rather than dial gauges, the registration device 20 may utilize commercially available electronic digital gauges 27, 27E, and 27F, that have a linear decoder that translates the linear movement of their plungers and displays it numerically on LCD displays 29.

Another aspect of the present invention is an exposure frame 60 for use in conjunction with the registration device 20 having three contact points corresponding to the plunger foot elements of the registration device that engage a framed silkscreen during exposure of the image to create silkscreens having images aligned relative to the registration device.

Figure 9:
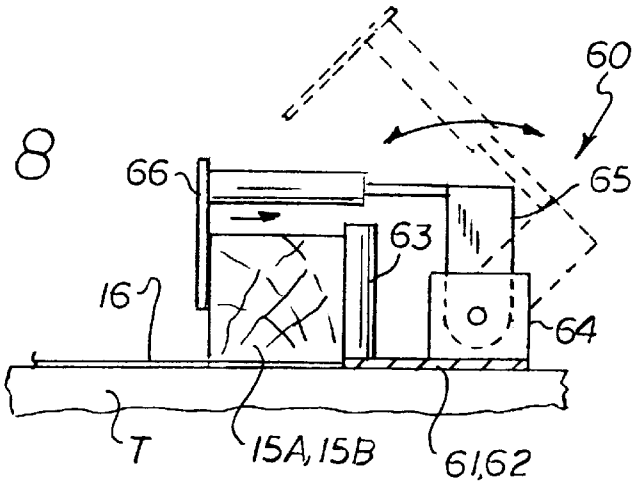
FIG. 9 is a cross section through one side of the exposure frame, showing a framed silkscreen clamped in the frame.
Figure 8:
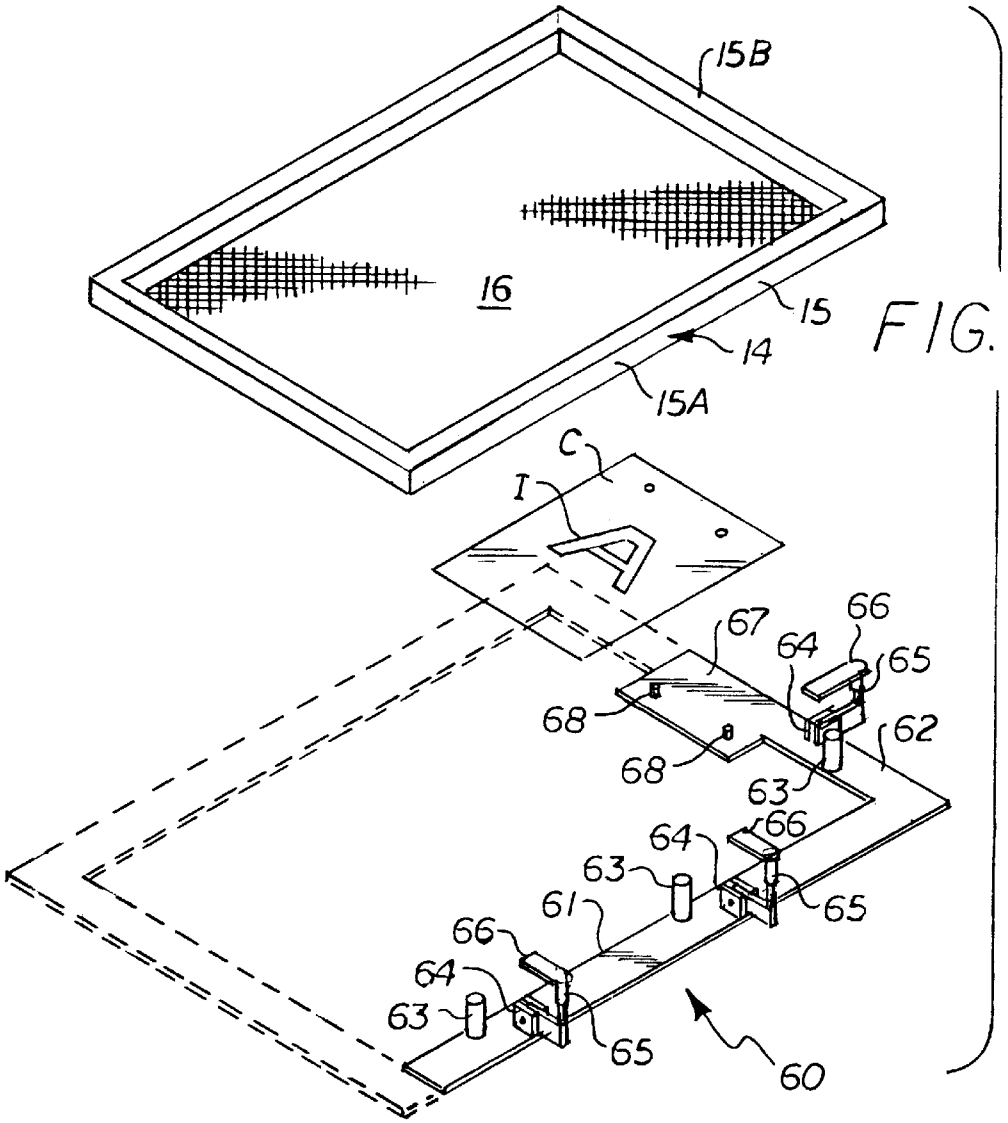
FIG. 8 is an exploded perspective view of an exposure frame in accordance with the present invention for use in conjunction with the registration device having three contacts corresponding to the plunger positions of the registration device that engage a framed silkscreen during exposure of the image to create silkscreens having images aligned relative to the registration frame.

Referring now to FIGS. 8 and 9, the exposure frame 60 is a thin L-shaped frame having a longitudinal first side leg 61 and a lateral second side leg 62 that are orthogonal relative to each other. A pair of vertical frame contact elements 63 are disposed flush with the inner edge of the longitudinal first side leg 61 at the same spacing apart as the two foot elements 31 of the first side 24 of the registration device 20 (FIGS. 1 and 2), and a third vertical contact element 63 flush with the inner edge of the lateral second side leg 62 is positioned at the same spacing as the third foot element 31 on the second side 25 of the registration device. In other words, the distance between and relative positions of the frame contacts 63 are the same as the foot elements 31 when the foot elements are in the fully retracted position (lever to the left, FIG. 6).

A pair of parallel ears 64 are disposed on the top side of the longitudinal leg 61 of the exposure frame 60 adjacent to each pair of frame contact element 63, and a third pair of parallel ears 64 are disposed on the lateral leg 62 adjacent to the third frame contact element 64. One end of a conventional extensible and retractable spring tension clamp 65 is pivotally connected at one end to each pair of ears 64, and has an L-shaped head 66 at its opposite end. The L-shaped heads 66 of the clamps 65 are spring biased to a normally retracted position by a tension spring inside of a tubular portion of the clamp head (conventional and therefore not shown). The clamps 65 are of sufficient size and length such that their L-shaped head portions will extend over the sides of the silkscreen frame.

The lateral second side leg 62 of the exposure frame 60 has a thin flat rectangular portion 67 with a set of laterally spaced pins 68 projecting upwardly from its top surface. The size and spacing of the pins 68 are the same as the pins of the conventional pin bar used on the light table which receive the punched holes of the carrier sheets when the film positives of the images are aligned and secured to the carrier sheets. The exposure frame 60 is secured to the glass top of an exposure table T, and the pins 68 receive the punched holes of the carrier sheets C having the film positives of the images I secured thereto when the images are to be burned into the silkscreens.

The exposure frame 60 may alternatively be a rectangular frame configuration with four sides surrounding a central opening, as shown in dashed line in FIG. 8.

In use, a carrier sheet C having a film positive of the first image I to be printed in a first color is placed on the pins 68 of the exposure frame 60. A framed silkscreen 14 coated with a light-sensitive, photochemical translucent emulsion is placed in the exposure frame 60 over the carrier sheet C with two of its orthogonal sides 15A and 15B placed against the frame contact elements 63. The L-shaped heads 66 of the clamps 65 are then pulled outwardly and over the two orthogonal sides 15A and 15B of the silkscreen frame 15 and then released to firmly clamp the frame sides against the frame contact elements 63 of the exposure frame 60. The conventional vacuum blanket of the exposure table is lowered onto the silkscreen frame and a vacuum is drawn to ensure that there no movement between the carrier sheets and screen mesh. The image is then exposed to a bright light and photochemically developed, or "burned-in", onto the screen. Thus, the image portion of the film positive is burned through the emulsion, leaving that portion of the screen mesh open and porous, while the non-image areas of the film positive will have no effect on the emulsion, thus leaving it on the screen. The burned-in image is aligned relative to the three contact elements 63 of the exposure frame 60, which also correspond to the three foot elements 31 of the registration device 20.

This process is repeated as necessary using subsequent carrier sheets and film positive images for the various different colors. The exposed silkscreens are washed in a known manner and are then ready to be mounted in the print heads of the printing machine.

OPERATION

The process utilizing the exposure frame for creating silkscreens having images aligned with respect to the same contact points of the plunger positions of the registration device has been described above. It should be understood that the registration device may be used to accurately register framed silkscreens in the printing heads which silkscreens may be produced by utilizing the exposure frame described above, or image-bearing silkscreens produced by conventional methods.

Initially, to calibrate the registration device 20, the lever 36 is moved to the right-hand position (FIG. 2) and the foot elements 31 are manually retracted to engage the slide rods 33 against the stop members 42A, 42B, and 42C, and each dial gauge 27A, 27B, and 27C is set to its zero setting. With each of the plungers 30 and foot elements 31 in their retracted stop condition, setting the gauges to display a zero setting, each of the foot elements 31 is at initial setting representing true perpendicular first and second orthogonal planes. It should also be noted that the position of the three foot elements 31 when the slide rods 33 are engaged against the stop members (zero dial gauge setting) corresponds to the position of the three contact elements of the exposure frame when the image was burned into the silkscreen.

A film positive P bearing an image registerable with the image on the silkscreen is secured onto the pallet 11 having the registration device 20 attached, and the pallet is rotated beneath the first printing head 10 (FIG. 1). The lever 36 of the registration device 20 is moved to the right-hand position (FIG. 2) which positions the stop members 42A, 42B, and 42C a distance from the ends 43 of the slide rods 33 so that the slide rods, plungers 30, and foot elements 31 can be retracted a predetermined distance before the slide rods 33 contact the stops, and the compression springs 32 urge the foot elements 31 and plungers 31 to their outermost position.

The silkscreen 14 to be registered is placed loosely into the silkscreen frame holder 13 of the first printing head. The lever 36 is moved to the left-hand position (FIG. 6) to fully retract the foot elements 31 and the pallet 11 is raised up. The lever 36 is moved to the right-hand position (FIG. 2) to place the stops behind the slide rods 33, and the orthogonal sides 15A and 15B of the silkscreen frame 15 are pulled against the three foot elements 31 to move them to their retracted stop position, and the silkscreen frame 15 is locked into the silkscreen frame holder 13 by actuating the pneumatic clamps 18. The clamping action may cause the silkscreen 14 to shift slightly.

Figure 5:
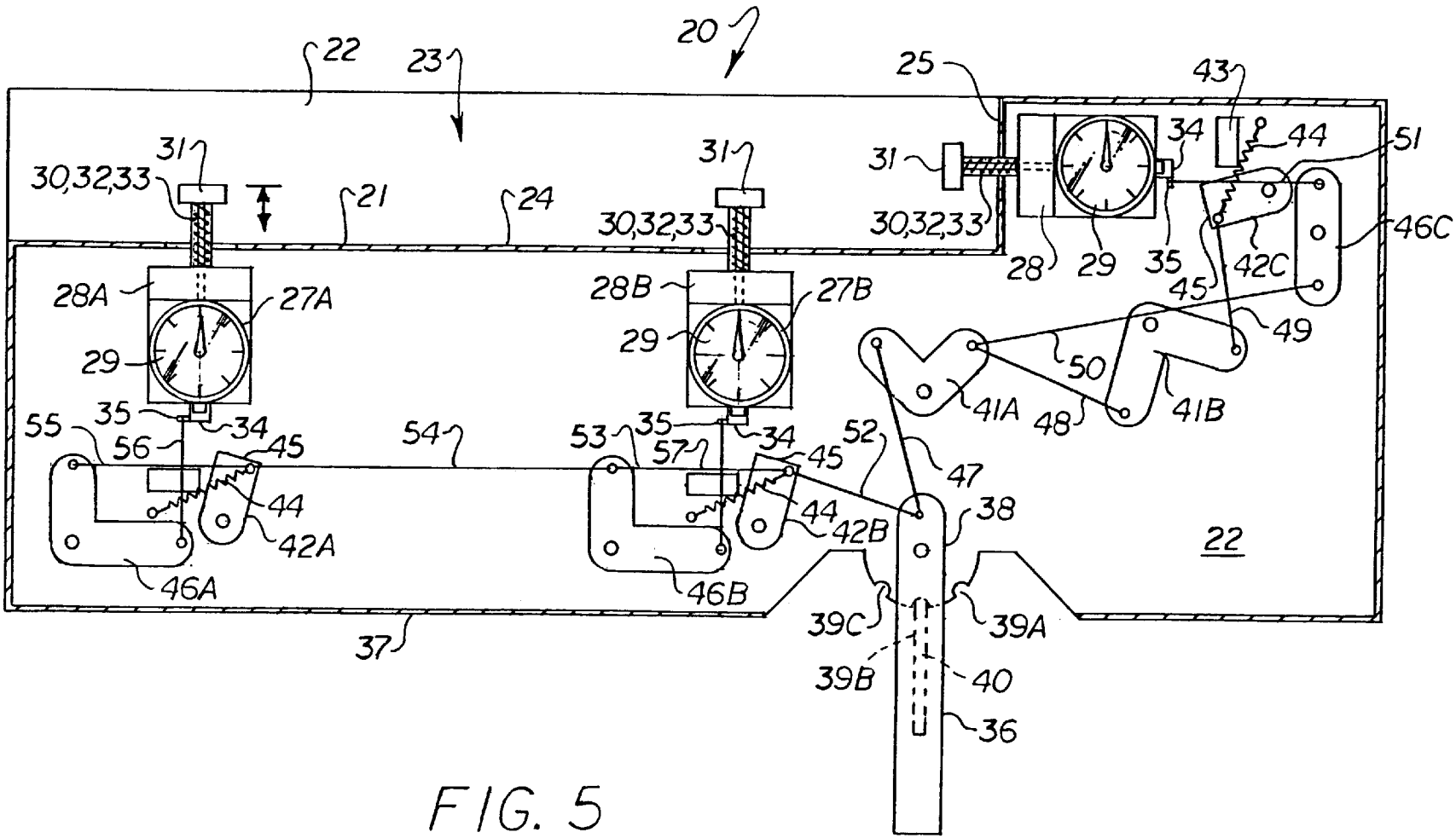
FIG. 5 is a top plan view of the interior of the registration frame, shown with the lever moved to the center position and the plungers in their free-floating position.

After the silkscreen frame 15 has been locked down by the clamps 18, the lever 36 of the registration device 20 is moved to the center position (FIG. 5). This simultaneously pulls all three stop members 42A, 42B, and 42C away from the ends of the slide rods 33 and allows the plungers 31, slide rods 33, and the foot elements 31 to become "free-floating" and to be extended or retracted by the movement of the orthogonal sides 15A and 15B the silkscreen frame 15 engaged by the foot elements. In this condition, the dial of each dial gauge 27A, 27B, and 27C will indicate the amount of displacement from its zero setting. For example, one gauge may still indicate a "0" setting, the second gage may have a reading of 0.020" and the third may have a reading of 0.30". This indicates that the frame did shift when clamped into the printing head, and the artwork is slightly out of registration.

With the lever 36 in its center position (free-floating foot elements), the operator observes the dials of the dial mechanism 19 to move the frame holder 13 and silkscreen 14 and adjustably fine-tune the clamped silkscreen until all three dial gauges are back to their initial zero settings. When the dials are set back to the zero settings, the image on the silkscreen should be accurately aligned with the artwork or image on the pallet 11. The micro-adjustment mechanism 19 is then locked down and the registration process for the first printing head is complete.

The lever 36 of the registration device 20 is moved the fully retracted left-hand position (FIG. 6), the pallet 11 lowered and rotated beneath the next printing head, and a second silkscreen with the next image for the next color is placed loosely in the frame holder 13. The pallet 11 is raised, the lever 36 is moved to the right-hand position (FIG. 2), the frame of the second silkscreen is pulled against the foot elements 31, and clamped down. The lever 36 is moved to its center position (FIG. 5) and, observing the dial gauges, the micro-registration is repeated, and the process is repeated again with all of the subsequent screens for the subsequent images to be reproduced in different colors.

Another feature of the present registration device 20 is that it allows the operator to quickly and easily check or verify whether or not a previously set screen has shifted, has become warped, or is still set at the zero position after the printing operation has begun, and also which silkscreen out of a plurality has shifted.

This is accomplished by moving the lever 36 to the left-hand position to retract all three foot elements 31 to their fully retracted position (FIG. 6). With the foot elements 31 retracted, the pallet 11 with the registration device 20 attached is raised to position the foot elements adjacent to the two orthogonal sides 15A and 15B of a silkscreen frame 15 which has been previously mounted in the frame holder 13 of the printing head clamps. After being so positioned, the lever is moved to the center position to release the slide rods 33, plungers 30 and foot elements 31 to become free-floating and to become extended or retracted as the foot elements 31 engage the two sides of the silkscreen frame so that another reading of each dial gauge can be taken to determine whether the previously registered silkscreen has shifted. If one or more of the dials indicate that the frame has shifted, the operator unlocks the micro-adjustment mechanism 19 and manipulates the adjustment knobs of the micro-registration mechanism to move the frame holder 13 and silkscreen 14 and adjustably fine-tunes the clamped silkscreen until all three dial gauges are back to their initial zero settings, and then locks down the micro-adjustment mechanism.

Still another feature of the present registration device is that it allows the operator to quickly and easily accurately register a silkscreen to compensate for instances where the artwork or image was not properly positioned during the exposure process, and register silkscreens which bear an image that was not burned-in using the exposure frame 60 of the present invention.

This is accomplished, as in the conventional visual registration process, by placing a film positive P of the image or test print down on the pallet 11, moving it beneath the silkscreen 14 in the printing head 10, raising the pallet, and then observing the film positive image through the translucent emulsion on the silkscreen, the operator visually aligns the image on the silkscreen with the image on the pallet and manipulates the silkscreen manually until the artwork on the screen is aligned with the artwork on the pallet. The silkscreen frame 15 is then locked into the silkscreen frame 13 by actuating the pneumatic clamps 19, and then observing through the translucent emulsion on the silkscreen, the knobs of the micro-registration mechanism 19 are manually turned to move the silkscreen frame holder and silkscreen to adjustably fine-tune the alignment of the silkscreen image to the artwork on the pallet.

Then the lever 36 of the registration device 20 is moved to the left-hand position (FIG. 6) to fully retract all three foot elements 31, the pallet 11 is raised so that the foot elements are adjacent to the two orthogonal sides 15A and 15B of the silkscreen frame 15, and the lever 36 is moved to the center position (FIG. 5) to release the foot elements to engage the sides of the frame in their "free-floating" condition. Then, observing the readings on the dial gauges 27A, 27B, and 27C, the operator can record the screen identification number and the readings of the three gauges on a card.

The card can then be secured to the silkscreen frame or placed in a file so that the next time that particular silkscreen is used, the silkscreen can be properly registered by placing it in the frame holder 13 of the printing head 10, moving the lever to the left-hand position (FIG. 6) to fully retract the foot elements 31, raising the pallet 11 and registration device 20 to position the foot elements adjacent to the sides 15A and 15B of the silkscreen, manipulating the silkscreen manually until the artwork on the screen is aligned with the artwork on the pallet as described above, and then locking the silkscreen 14 into the silkscreen frame holder 13 by actuating the pneumatic clamps 18. The lever 36 is then moved to its center position (FIG. 5) to allow the foot elements 31 to engage the sides 15A and 15B of the screen frame 15. Then, observing the dial gages 27A, 27B, and 27C, the operator can by manipulate the micro-registration adjustment knobs so that each of the dial gauges has its previously recorded reading.

While this invention has been described fully and completely with special emphasis upon preferred embodiments, it should be understood that within the scope of the appended claims the invention may be practiced otherwise than as specifically described herein.

What is claimed is:

1. A system for registering at least one silkscreen having an image formed thereon in a printing machine having at least one printing head including frame holding means to engage the frame of a silkscreen and manual adjustment means for adjusting the frame holding means and engaged silkscreen relative to the printing head, and at least one pallet for supporting an article to be printed moveable into a printing position beneath the silkscreen engaged in the frame holding means, comprising:

a registration device associated with said pallet having a first side and a second side orthogonal relative to each other and a first pair of extensible and retractable plungers extending normal to said first side to engage a first side of the silkscreen frame and one extensible and retractable plunger extending normal to said second side to engage a second side of said screen frame, said first and second sides of said silkscreen frame being orthogonal relative to each other;

gauge means coupled with each of said plungers including visual display means for displaying the amount of extension and retraction of each of said plungers relative to predetermined initial settings; and lever means coupled with said first pair and said one extensible and retractable plungers for selectively moving said plungers simultaneously between;

a fully retracted condition laterally spaced from said silkscreen frame first and second sides to provide clearance between said plungers and said silkscreen frame first and second sides when said pallet is moved into and out of said printing position;

an extensible and partially retracted stop condition extensible to engage said silkscreen frame first and second sides and retractable a distance corresponding to said predetermined initial settings when said pallet is in said printing position so that said silkscreen frame first and second sides may be manually pressed against and retract said plungers to said partially retracted position such that said silkscreen frame first and second sides correspond to said initial settings of each of said plungers prior to engagement of said frame holding means; and a free-floating extensible and retractable condition extensible to engage said silkscreen frame first and second sides when said pallet is in said printing position and said frame holding means is engaged so that said display means will display the amount of extension and retraction of each of said plungers relative to said initial settings; and with said extensible and retractable plungers in said free floating condition, the frame holding means and engaged silkscreen being adjustable relative to the printing head as required by observing said display and adjusting the manual adjustment means until said initial settings are displayed.

2. The system according to claim 1, further comprising:

an exposure device associated with a back-lighted exposure table for receiving and releasably holding a framed silkscreen having a screen with a light-sensitive emulsion coating thereon during exposure and burning an image onto the screen, said framed silkscreen having a silkscreen frame with a first side and a second side orthogonal relative to each other;

said exposure device having a first side and a second side orthogonal relative to each other and a first pair of contact elements on said device first side to engage said silkscreen first side and one contact element on said device second side to engage said silkscreen second side;

said contact elements positioned relative to each other at substantially the same relative position as said first pair of extensible and retractable plungers and said one extensible and retractable plunger of said registration device, respectively;

sheet positioning means on said exposure device second side for receiving an image bearing sheet; and a first pair of frame clamping members on said exposure device first side and one clamping member on said exposure device second side, said clamping members engageable with said framed silkscreen to bias said silkscreen frame first side into engagement with said first pair of contact elements and said silkscreen frame second side into engagement with said one contact element.

3. A method for registering at least one silkscreen having an image formed thereon in a printing machine having at least one printing head including frame holding means to engage the frame of a silkscreen and manual adjustment means for adjusting the frame holding means and engaged silkscreen relative to the printing head, and at least one pallet for supporting an article to be printed moveable into a printing position beneath the silkscreen engaged in the frame holding means, said method comprising the steps of:

providing a registration device on said pallet having a first side and a second side orthogonal relative to each other and a first pair of extensible and retractable plungers extending normal to said first side to engage a first side of the silkscreen frame and one extensible and retractable plunger extending normal to said second side to engage a second side of said screen frame, said first and second sides of said silkscreen frame being orthogonal relative to each other, gauge means coupled with each of said plungers including visual display means for displaying the amount of extension and retraction of each of said plungers relative to predetermined initial settings, and lever means coupled with said first pair and said one extensible and retractable plungers for selectively moving said plungers;

placing said silkscreen in said frame holding means;

moving said plungers to a fully retracted condition, and moving said pallet into said printing position with said fully retracted plungers laterally spaced from said silkscreen frame first and second sides to provide clearance therebetween;

moving said plungers to an extensible and partially retracted stop condition extensible to engage said silkscreen frame first and second sides and retractable a distance corresponding to said predetermined initial settings;

prior to engagement of said frame holding means, manually pressing said silkscreen frame first and second sides against said plungers to retract said plungers to said partially retracted stop condition such that said silkscreen frame first and second sides correspond to said initial settings of each of said plungers;

engaging said frame holding means with said silkscreen frame, and moving said plungers to a free-floating extensible and retractable condition extensible to engage said silkscreen frame first and second sides so that said display means will display the amount of extension and retraction of each of said plungers relative to said initial settings after engagement of said frame holding means; and with said extensible and retractable plungers in said free-floating condition, observing said display and adjusting said manual adjustment means to move said frame holding means and said engaged silkscreen relative to the printing head as required until said initial settings are displayed.

4. The method according to claim 3, including the preliminary steps of:

providing an exposure device on a back-lighted exposure table for forming said image in a light-sensitive emulsion coating on the screen of said silkscreen to be placing in said frame holding means;

said exposure device having a first side and a second side orthogonal relative to each other and a first pair of contact elements on said device first side to engage said silkscreen first side and one contact element on said device second side to engage said silkscreen second side, said contact elements positioned relative to each other at substantially the same relative position as said first pair of extensible and retractable plungers and said one extensible and retractable plunger of said registration device, respectively, sheet positioning means on said exposure device second side for receiving an image bearing sheet, and a first pair of frame clamping members on said exposure device first side and one clamping member on said exposure device second side;

placing said image bearing sheet on said positioning means so that said sheet is resting flat on said exposure table;

placing said silkscreen on said exposure table over said image bearing sheet with said silkscreen frame first and second sides against said first pair of contact members and said one contact element, respectively;

engaging said clamping members with said silkscreen to bias said silkscreen frame first side into engagement with said first pair of contact elements and said silkscreen frame second side into engagement with said one contact element;

lowering a vacuum blanket of the exposure table onto said silkscreen, drawing a vacuum to prevent movement between said image bearing sheet and said silkscreen, burning said image of said sheet onto the screen;

releasing said clamping members and removing said silkscreen having an image formed thereon.

5. The method according to claim 4, including the further preliminary steps of:

prior to engagement of said frame holding means, and after manually pressing said silkscreen frame first and second sides against said plungers to retract said plungers to said partially retracted stop condition, as recited in claim 3;

setting said display means to display a zero, whereby the zero and partially retracted stop condition of each of said plungers is an initial setting representing that said silkscreen frame first and second sides correspond to their position when engaged with said contact members of said exposure device and said image was formed thereon; and thereafter carrying out the remaining steps as recited in claim 3.

6. A method for registering at least one silkscreen having an image formed thereon in a printing machine having at least one printing head including frame holding means to engage the frame of a silkscreen and manual adjustment means for adjusting the frame holding means and engaged silkscreen relative to the printing head, and at least one pallet for supporting an article to be printed moveable into a printing position beneath the silkscreen engaged in the frame holding means, said method comprising the steps of:

providing a registration device on said pallet having a first side and a second side orthogonal relative to each other and a first pair of extensible and retractable plungers extending normal to said first side to engage a first side of the silkscreen frame and one extensible and retractable plunger extending normal to said second side to engage a second side of said screen frame, said first and second sides of said silkscreen frame being orthogonal relative to each other, gauge means coupled with each of said plungers including visual display means for displaying the amount of extension and retraction of each of said plungers relative to predetermined initial settings, and lever means coupled with said first pair and said one extensible and retractable plungers for selectively moving said plungers;

placing said silkscreen in said frame holding means;

securing onto said pallet an image registerable with said image on said silkscreen;

moving said plungers to a fully retracted condition, and moving said pallet with said image thereon into said printing position with said fully retracted plungers laterally spaced from said silkscreen frame first and second sides to provide clearance therebetween;

moving said plungers to an extensible and partially retracted stop condition extensible to engage said silkscreen frame first and second sides and retractable a predetermined distance corresponding to true perpendicular first and second orthogonal planes;

with each of said plungers in said partially retracted stop condition, setting said display means to display a zero, whereby the zero and partially retracted stop condition of each of said plungers is an initial setting representing true perpendicular first and second orthogonal planes;

prior to engagement of said frame holding means, manually manipulating said silkscreen to visually align the image formed on said silkscreen with the image on said pallet;

engaging said frame holding means with said silkscreen frame;

moving said plungers to a free-floating extensible and retractable condition extensible to engage said silkscreen frame first and second sides so that said display means will display the amount of extension and retraction of each of said plungers relative to said initial settings;

with said extensible and retractable plungers in said free-floating condition, adjusting said manual adjustment means to move said frame holding means and said engaged silkscreen relative to the printing head as required to visually align the image formed on said silkscreen with the image on said pallet;

observing said display means and recording the values displayed, said values representing the amount of extension and retraction of each of said plungers and the position of said silkscreen first and second sides relative to said initial settings when the image on said silkscreen is visually aligned with the image on said pallet; and identifying the recorded settings with that particular said silkscreen, so that upon subsequent use, said recorded readings will be the preferred settings for that particular silkscreen to facilitate proper registration.

7. The method according to claim 6, including the further steps of;

after identifying the recorded settings with that particular said silkscreen, and upon subsequent use of said particular silkscreen;

placing said particular silkscreen in said frame holding means;

moving said plungers to a fully retracted condition, and moving said pallet into said printing position with said fully retracted plungers laterally spaced from said particular silkscreen frame first and second sides to provide clearance therebetween;

moving said plungers to an extensible and partially retracted stop condition extensible to engage said particular silkscreen frame first and second sides and retractable a predetermined distance corresponding to true perpendicular first and second orthogonal planes;

with each of said plungers in said partially retracted stop condition, setting said display means to display a zero, whereby the zero and partially retracted stop condition of each of said plungers is an initial setting representing true perpendicular first and second orthogonal planes;

engaging said frame holding means with said particular silkscreen frame, and moving said plungers to a free-floating extensible and retractable condition extensible to engage said particular silkscreen frame first and second sides so that said display means will display the amount of extension and retraction of each of said plungers relative to said initial settings after engagement of said frame holding means; and with said extensible and retractable plungers in said free-floating condition, observing said display and adjusting said manual adjustment means to move said frame holding means and said engaged particular silkscreen relative to the printing head as required until said recorded preferred settings for said particular silkscreen are displayed.

* * * * *